US006099185A

United States Patent [19]

Huang et al.

[11] Patent Number: 6,099,185

[45] Date of Patent: Aug. 8, 2000

[54] LIGHT PEN WITH MULTICOLOR LIGHT SOURCES

[75] Inventors: Fang-Yue Huang; Wen-Bin Chiou, both of Hsinchu; Rong-Yih Hwang, Hsinchu Hsien, all of Taiwan

[73] Assignee: Excellence Optoelectronics Inc., Taiwan

[21] Appl. No.: 09/370,322

[22] Filed: Aug. 9, 1999

[51] Int. Cl.[7] ..... B43K 29/00

[52] U.S. Cl. ..... 401/195; 401/52; 362/118

[58] Field of Search ..... 401/195, 52; 362/118, 362/343, 255, 202, 800, 802, 230, 231, 313

[56] References Cited

U.S. PATENT DOCUMENTS 2,663,791 12/1953 Hettrick ..... 362/579
2,811,632 7/1957 Barlett ..... 362/579
4,890,204 12/1989 Lin et al. ..... 362/118
5,131,775 7/1992 Chen ..... 401/195

FOREIGN PATENT DOCUMENTS 4143297 6/1993 Germany .

*Primary Examiner*—Henry J. Recla
*Assistant Examiner*—Huyen Le
*Attorney, Agent, or Firm*—Ostrolenk, Faber, Gerb & Soffen, LLP

[57] ABSTRACT

A light pen with multicolor light sources comprise a pen holder and a pen body wherein the pen body which slips on the pen holder can generate multicolor light sources, and the pen body further comprises a multicolor Light Emitting Diode (LED), a housing, and a conductive stand wherein the LED and the conductive stand are installed respectively at both ends of the housing. By turning the knob on the conductive stand, the conductive piece therein timely contacts the positive leads of different chips of LED in order to make the multicolor LED timely generate multicolor light sources to facilitate the convenient usage of light pen.

3 Claims, 5 Drawing Sheets

LIGHT PEN WITH MULTICOLOR LIGHT SOURCES

FIELD OF INVENTION

The present invention relates to a light pen with multicolor light sources, and more particularly to a light pen capable of adjusting the required color of light source depending on the using situations of the user to facilitate the convenient and practical usage of light pen.

BACKGROUND OF THE INVENTION

Although the pen is an important tool of our daily life nowadays, the pen having only a single function is very hard to attract the consumer. Currently a new kind of light pen is found in the market. The new light pen has a light source set up at the tail end of the pen holder to illuminate throughout the pen nib via the guidance of the pen holder to facilitate the reading for the consumer under the dusky condition. But when it comes to read the writing on the paper with different colors and if the color of the light source happens to be in the same color code of the color of the paper, the writing becomes not legible. What is more, the pen is always taken along with us but not the flashlight, therefore, it would be very convenient for us if the function of illumination can be added to the pen, for instance, when it comes to search for articles or search the key hole for opening the door in the dark, the pen taken along with us and having the light source can be functioned as a mini-flashlight to overcome this kind of difficulty.

SUMMARY OF THE INVENTION

The primary objective of the present invention is to provide a light pen capable of generating multicolor light sources in order to accommodate different colors of paper and pen ink so as to free the user from the disturbance that the color of paper and pen ink being the same as that of the light source, and the user can adjust to select the desired color of light source in accordance with personal preference.

The secondary objective of the present invention is to provide a light pen which has the function of the flashlight since the pen body at the end of the light pen can be separated from the pen holder to be functioned as a mini-flashlight, meanwhile, the fact that the present invention possesses the feature of adjustable multicolor light source increases the practical value of the present invention, for instance, when it comes to search for the key hole in order to open the door, one can select a color of light source different from that of the door to increase the prominence of the light source and save time for searching, thereby, the present invention is very practical.

Another objective of the present invention is to provide a light pen with multicolor variation having the function of prominence and alarm since the pen holder itself possesses the transparency and light conductance. In concert with the multicolor light source provided by the pen body at the tail end of the light pen, the present invention can become a light pen having multicolor variation for temporary writing or become a mini-light-tube having multicolor transformation under the dusky condition.

For a better understanding of the present invention, reference will now be made by way of embodiments to the accompanying drawings:

DETAIL DESCRIPTION OF THE INVENTION

Figure 1:
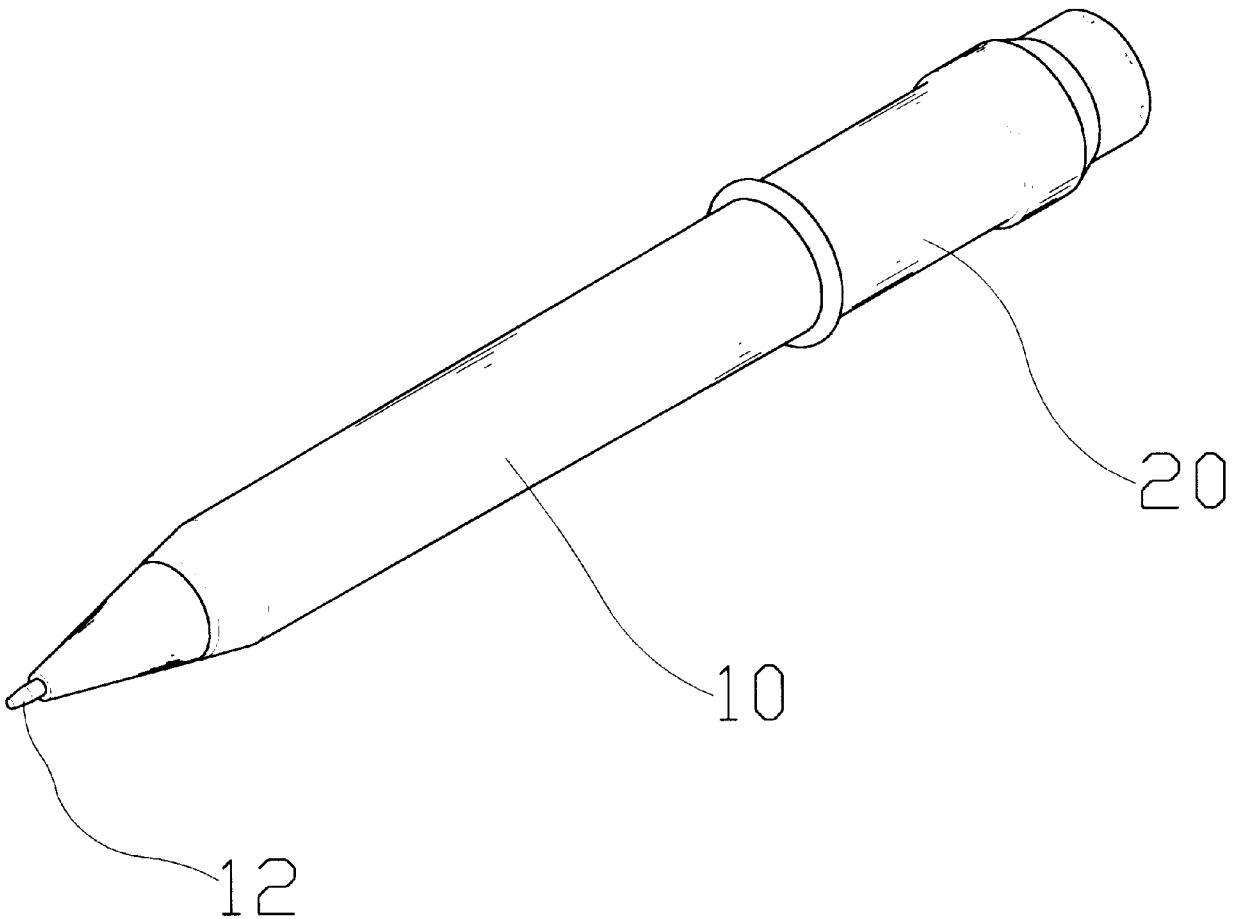
FIG. 1 is the pictorial view of the present invention.
Figure 2:
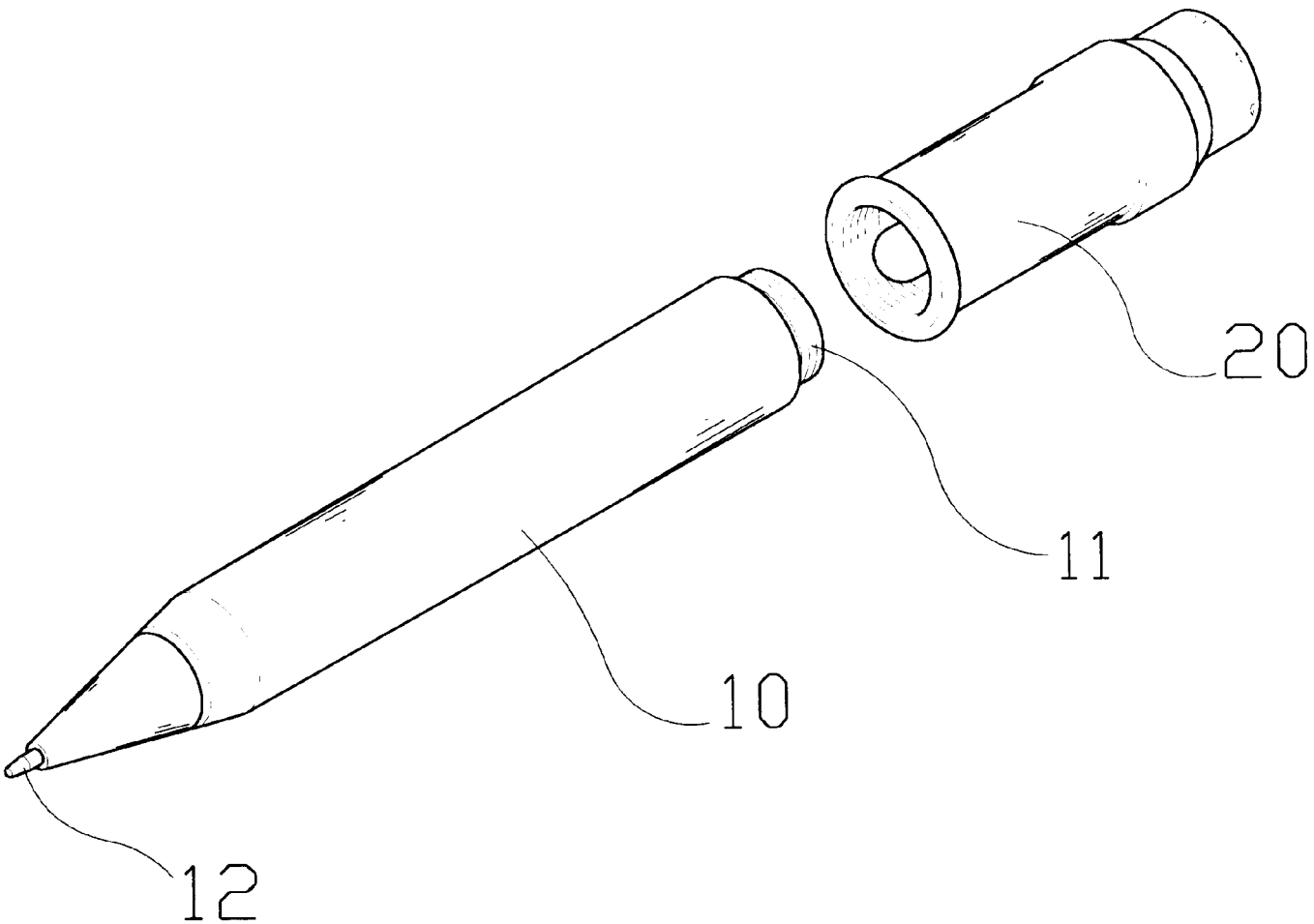
FIG. 2 is the pictorial schematic view showing the separation of the pen holder and the pen body of the present invention.

With reference to the pictorial view of FIG. 1 and FIG. 2, the present invention comprises a pen holder 10 having an outer tube with a front end and a tail end and a pen body 20 wherein the pen body 20 is connected to the pen holder 10 at the tail end 11 by screw-type connection, and a pen core 12 is set up inside the pen holder 10 for the writing of the user.

Figure 3:
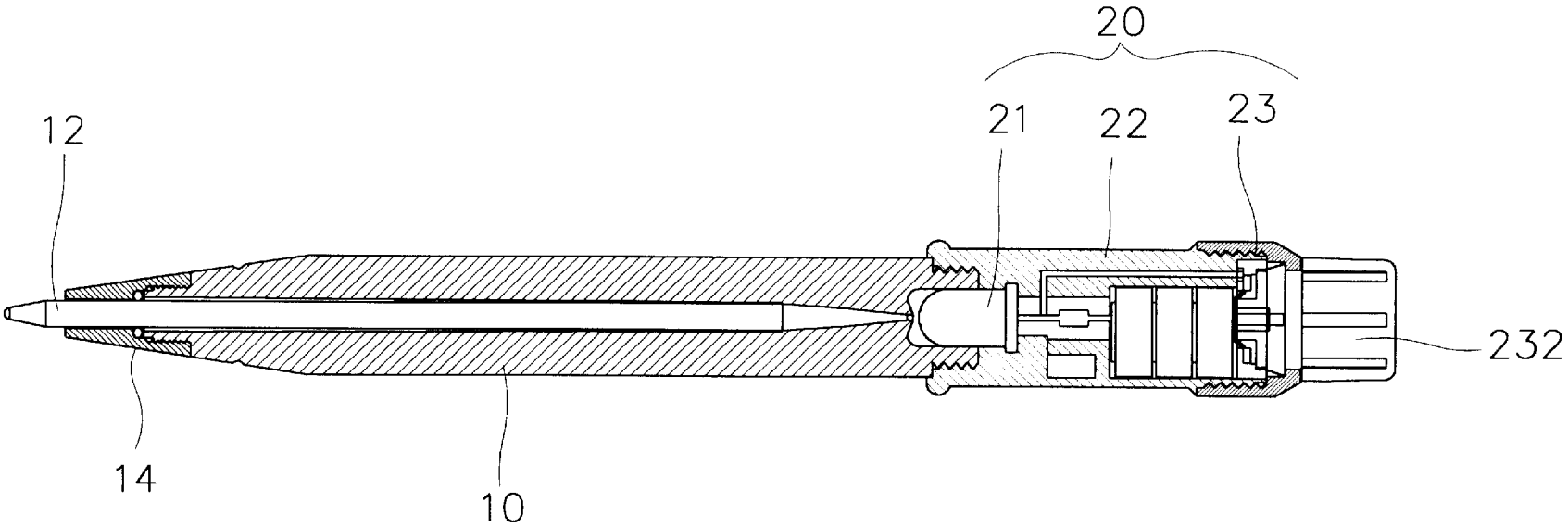
FIG. 3 is the longitudinal cross-section view of the present invention.
Figure 5:
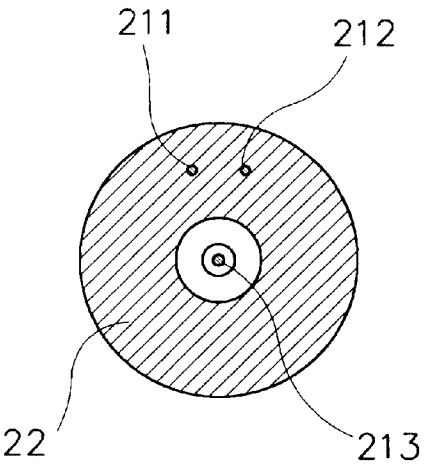
FIG. 5 is the cross-sectional view at section A—A in FIG. 4 of the present invention.
Figure 4:
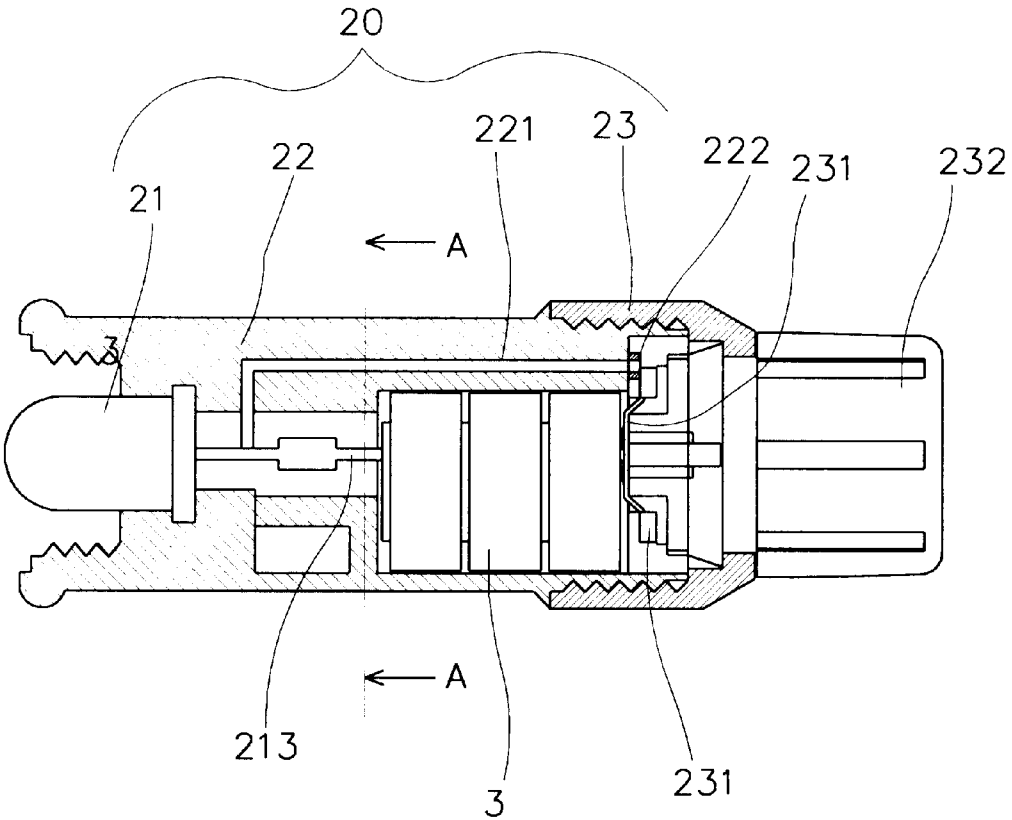
FIG. 4 is the enlarged longitudinal cross-section view of the pen body of the present invention.

As shown in the longitudinal cross-section view of FIG. 3, the pen holder 10 itself can be made of a transparent material such as transparent plastic in order to guide the light source, generated by a multicolor LED 21set up in the pen body 20, to a nib 14 set up at the front end of the pen holder 10 or to diffuse the light to the outer tube in order to provide the user with illumination. With reference to FIG. 4, the pen body 20 further comprises the multicolor LED 21, a housing 22, and a conductive stand 23 wherein the multicolor LED 21 contains a plurality of chips capable of generating different color of light source, the embodiment provides here is capable of generating to two color light sources wherein one light source is generated when a positive lead 211 is contacted and the other light source is generated when a positive lead 212 is contacted while a negative lead is set up at the center of the housing 22 as shown in FIG. 5.

The housing 22 is a hollow tube with a LED 21 contained inside in the space in the front section while batteries 3 are contained in the space in the rear section. The front section communicates with the rear sections such that the negative lead 213 on the multicolor LED 21 is able to contact the batteries 3, and two guided passageways 221 are set up near the inner wall surface of the pen body 20 extending to the tail end (only one passageway is shown in the longitudinal cross-section view in FIG. 4), and two metal rings 222 are set up at the exits to be inserted by the positive leads 211 and 212 respectively as shown in FIG. 5 in order to timely contact a plurality of conductive pieces 231 set up at the tail end of the pen body 20 to generate different color of light source.

The conductive stand 23 having a set-up of a knob 232 is connected to the tail end of the housing 22 by screw-type connection. As shown in FIG. 4, the conductive stand 23 is represented by cross-section lines while the knob 232 itself is not shown by cross-sectional view. A portion of the structure of the knob 232 is set up inside the conductive stand 23 wherein a conductive piece 231 is set up at the bottom of the knob 232. The conductive piece 231 which is a narrow arc shape metal piece is transversely disposed at the bottom of the knob 232 and is normally kept in contact with other end of battery 3 by its center part while both ends of the conductive piece 231 can contact with only one of the positive leads 211, 212 of the multicolor LED 21 at the same time to make the circuit conductive in order to generate the required color of the light source. The location of the conductive piece 231 can be varied by turning the knob 232 to contact different positive lead 211, 212 in order to generate the variation of multicolor light sources, thereby, if the multicolor LED 21 contains three or four or even more multicolor chips, more different color of light sources can then be generated.

Figure 6:
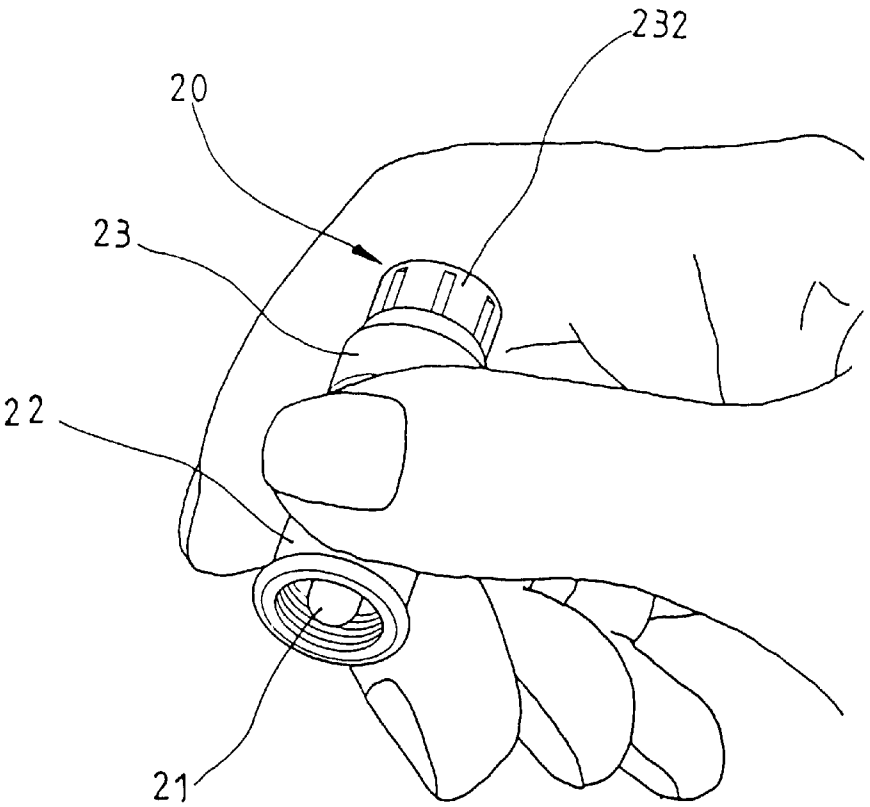
FIG. 6 is an embodiment of the present invention.

With reference to the embodiment of the present invention of FIG. 6, the pen body 20 which is separated from the pen holder 10 becomes a mini-flashlight. By turning the knob 232 of the conductive stand 23 on top of the pen body 20, the conductive piece 231 will contact the respective positive leads 211 or 212 of the multicolor LED 21 in order to generate the required color of light sources to meet the practical needs to avoid the malfunction of illumination when the color of the light source and the object desired to be illuminated belong to the same color code.

Although the present invention has been illustrated and described previously with reference to the preferred embodiment thereof, it should be appreciated that it is in no way limited to the details of such embodiment, but is capable of numerous modification within the scope of the appended claims.

What is claimed is:

1. A light pen with multicolor light source comprising:

a pen holder having an outer tube with a front end and a tail end; wherein a central hollow space is set up to contain a pen core, said pen holder is made of transparent or semi-transparent material;

a pen body attached to a tail end of said pen holder comprising a multicolor LED, a housing and a conductive stand wherein said housing contains a plurality of batteries to provide the required power supply for said multicolor LED;

said pen body is separable from said tail end of said pen holder to be used independently, and said pen body is to generate at least two different color of light sources whereby the is diffused through light to the outer tube and to guide the light toward a pen nib in the front end of said pen holder by the guidance of said pen holder.

2. A light pen with multicolor light source as claimed in claim 1 wherein said housing is a hollow tube having a front section and a rear section; with said multicolor LED contained in said front section and said plurality of batteries contained in said rear section; a negative lead of said multicolor LED is in contact with one end of said batteries and a pair of positive leads of said multicolor LED disposed in two guided passageways which are set up near the inner wall surface of said pen body extending from said front section to said rear section; wherein said conductive stand having a knob is connected to said rear section of said housing by a screw-type connection; a bottom portion of the said knob is set up inside said conductive stand, wherein a conductive piece which is attached to said bottom portion is normally kept in contact with other end of said batteries by is center part, while both ends of said conductive piece is to contact with only one of said positive leads of said multicolor LED to make the circuit conductive in order to generate the required color of the light source.

3. A light pen with multicolor light sources as claimed in claim 1 wherein said multicolor LED is to generate at least two different color of light sources.

* * * * *